US011527829B1

(12) United States Patent
Chiang

(10) Patent No.: US 11,527,829 B1
(45) Date of Patent: Dec. 13, 2022

(54) DUAL-POLARIZED ANTENNA STRUCTURE

(71) Applicant: AUDEN TECHNO CORP., Taoyuan (TW)

(72) Inventor: Chi-Ming Chiang, Taoyuan (TW)

(73) Assignee: AUDEN TECHNO CORP., Taoyuan (TW)

( * ) Notice: Subject to any disclaimer, the term of this patent is extended or adjusted under 35 U.S.C. 154(b) by 0 days.

(21) Appl. No.: 17/471,113

(22) Filed: Sep. 9, 2021

(30) Foreign Application Priority Data

May 18, 2021 (TW) ..... 110117904

(51) Int. Cl.
*H01Q 1/38* (2006.01)
*H01Q 9/04* (2006.01)
*H01Q 21/24* (2006.01)

(52) U.S. Cl.
CPC ..... *H01Q 9/0435* (2013.01); *H01Q 1/38* (2013.01); *H01Q 9/0457* (2013.01); *H01Q 21/24* (2013.01)

(58) Field of Classification Search
CPC ..... H01Q 9/0435; H01Q 1/38; H01Q 9/0457; H01Q 21/24; H01Q 1/243
See application file for complete search history.

(56) References Cited

U.S. PATENT DOCUMENTS

2002/0190912 A1* 12/2002 Lebaric ..... H01Q 9/28 343/816
2004/0183727 A1* 9/2004 Choi ..... H01Q 21/08 343/702
2010/0060526 A1* 3/2010 Cheng ..... H01Q 1/38 343/700 MS
2022/0209398 A1* 6/2022 Chiang ..... H01Q 21/0006
2022/0209399 A1* 6/2022 Chiang ..... H01Q 9/045

* cited by examiner

*Primary Examiner* — David E Lotter
(74) *Attorney, Agent, or Firm* — Li & Cai Intellectual Property Office

(57) ABSTRACT

A dual-polarized antenna structure is provided. The dual-polarized antenna structure includes an insulating substrate, two first antennas, two second antennas, a coupling unit, and two feeding points. The two first antennas are disposed on two sides of the insulating substrate, respectively. The two second antennas are disposed on the two sides of the insulating substrate, respectively. Each of the two second antennas includes two sub-antennas. In any one of the two sides of the insulating substrate, a region defined by orthogonally projecting two sub-middle segments of the two sub-antennas onto another one of the two sides of the insulating substrate overlaps with a main middle segment of the first antenna. The coupling unit is electrically coupled to the two sub-antennas on each of the two sides of the insulating substrate. The two feeding points are electrically coupled to the two first antennas and the two second antennas.

10 Claims, 14 Drawing Sheets

100B

100B

100B

100C

100C

DUAL-POLARIZED ANTENNA STRUCTURE

CROSS-REFERENCE TO RELATED PATENT APPLICATION

This application claims the benefit of priority to Taiwan Patent Application No. 110117904, filed on May 18, 2021. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an antenna structure, and more particularly to a dual-polarized antenna structure.

BACKGROUND OF THE DISCLOSURE

Conventional dual-polarized antenna structures mostly include a double antenna and a reflecting plate. Although such structures have an advantage of having a low cost, a gain value thereof is not high. Accordingly, to address the issue of "the gain value being not high" in the above-mentioned structures, a three-dimensional dipole antenna structure having a balance function is provided. However, while the three-dimensional dipole antenna structure can solve the foregoing issue, such a solution involves a higher cost. Therefore, how the dual-polarized antenna structure can be configured to have both the advantages of a high gain value and a low cost is an important topic in the related art.

SUMMARY OF THE DISCLOSURE

In response to the above-referenced technical inadequacies, the present disclosure provides a dual-polarized antenna structure to effectively improve on the issues associated with conventional antenna structures.

In one aspect, the present disclosure provides a dual-polarized antenna structure. The dual-polarized antenna structure includes an insulating substrate, two first antennas, two second antennas, a coupling unit, a first feeding point, and a second feeding point. The insulating substrate sequentially defines a first direction, a second direction, a third direction, and a fourth direction that sequentially differ by an angle of 90 degrees. The insulating substrate has a first board surface and a second board surface that is opposite to the first board surface. The two first antennas are disposed on the first board surface and the second board surface, respectively. Each of the two first antennas has a main middle segment and two main side segments that are respectively connected to two ends of the main middle segment. A region defined by orthogonally projecting the main middle segment on the first board surface onto the second board surface is perpendicular to the main middle segment on the second board surface. The two main side segments on the first board surface extend in the first direction, and the two main side segments on the second board surface extend in the fourth direction. The two second antennas are disposed on the first board surface and the second board surface, respectively. Each of the two second antennas includes two sub-antennas. In one of the two second antennas disposed on the first board surface, the two sub-antennas each have one of two first sub-middle segments and one of two first sub-side segments. The two first sub-middle segments are disposed on the first board surface and are spaced apart from each other, and a region defined by orthogonally projecting the two first sub-middle segments onto the second board surface overlaps with the main middle segment on the second board surface. In one of the two second antennas disposed on the first board surface, the two first sub-middle segments each have one of two ends that are away from each other, the two ends are respectively connected to the two first sub-side segments, and the two first sub-side segments extend in the second direction. In one of the two second antennas disposed on the second board surface, the two sub-antennas each have one of two second sub-middle segments and one of two second sub-side segments. The two second sub-middle segments are disposed on the second board surface and are spaced apart from each other, and a region defined by orthogonally projecting the two second sub-middle segments onto the first board surface overlaps with the main middle segment on the first board surface. In one of the two second antennas disposed on the second board surface, two ends of the two second sub-middle segments each have one of two ends that are away from each other, the two ends are respectively connected to the two second sub-side segments, and the two second sub-side segments extend in the third direction. The coupling unit is disposed on the insulating substrate and electrically coupled to the two sub-antennas on the first board surface and the two sub-antennas on the second board surface. The first feeding point is disposed on the insulating substrate and corresponds in position to a middle position between the two first antennas. The first feeding point is electrically coupled to the two first antennas. The second feeding point is electrically coupled to the coupling unit and corresponds in position to a middle position between the two second antennas.

Therefore, by virtue of "the coupling unit being disposed on the insulating substrate and being electrically coupled to the two sub-antennas on the first board surface and the two sub-antennas on the second board surface" and "the first feeding point corresponding in position to the middle position between the two first antennas and being electrically coupled to the two first antennas, and the second feeding point corresponding in position to the middle position between the two second antennas and being electrically coupled to the coupling unit," the dual-polarized antenna structure provided by the present disclosure can have advantages of high gain value and low cost.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
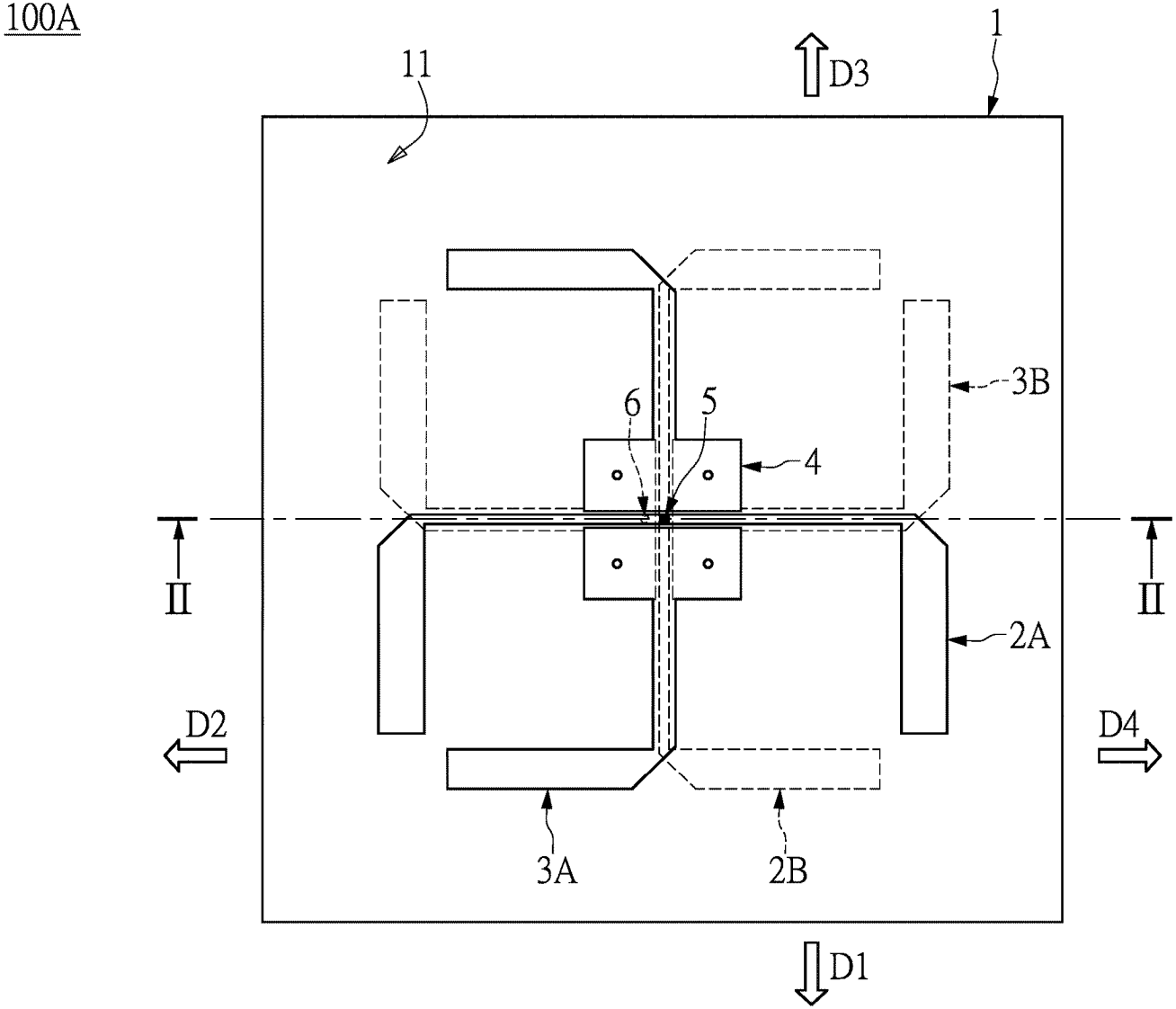
FIG. 1 is a schematic planar view of a dual-polarized antenna structure according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Referring to FIG. 1 to FIG. 7, a first embodiment of the present disclosure provides a dual-polarized antenna structure 100A that is configured to be operated in a transmission frequency band. Referring to FIG. 1, the dual-polarized antenna structure 100A includes an insulating substrate 1, two first antennas 2A, 2B and two second antennas 3A, 3B disposed on the insulating substrate 1, a coupling unit 4 electrically coupled to the two second antennas 3A, 3B, a first feeding point 5 electrically coupled to the two first antennas 2A, 2B, and a second feeding point 6 that is electrically coupled to the coupling unit 4. Next, the following description describes the structure and connection relation of each component of the dual-polarized antenna structure 100A.

Figure 2:
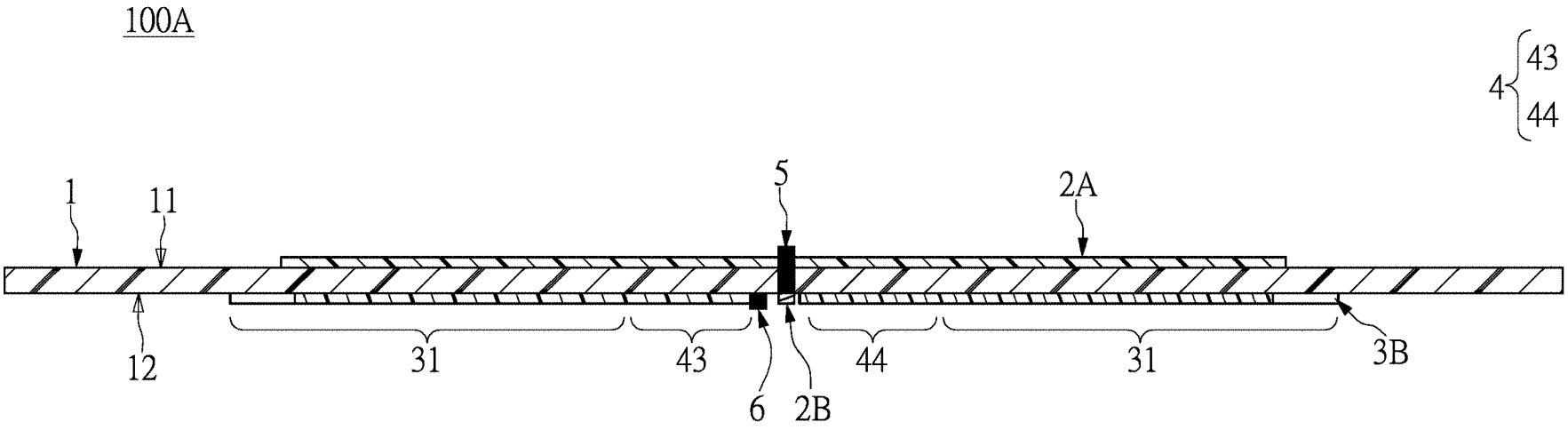
FIG. 2 is a cross-sectional view taken along line II-II of FIG. 1.

Referring to FIG. 1 and FIG. 2, the insulating substrate 1 in the present disclosure is a sheet structure in a rectangular shape, and has a first board surface 11 and a second board surface 12 that is opposite to the first board surface 11, but the appearance of the insulating substrate 1 is not limited thereto.

For convenience of description, the insulating substrate 1 sequentially defines a first direction D1, a second direction D2, a third direction D3, and a fourth direction D4 that sequentially differ by an angle of 90 degrees. For example, referring to FIG. 1 (or FIG. 3 and FIG. 4), the first direction D1 extends downward from the insulating substrate 1, the second direction D2 extends leftward from the insulating substrate 1, the third direction D3 extends upward from the insulating substrate 1, and the fourth direction D4 extends rightward from the insulating substrate 1.

Figure 3:
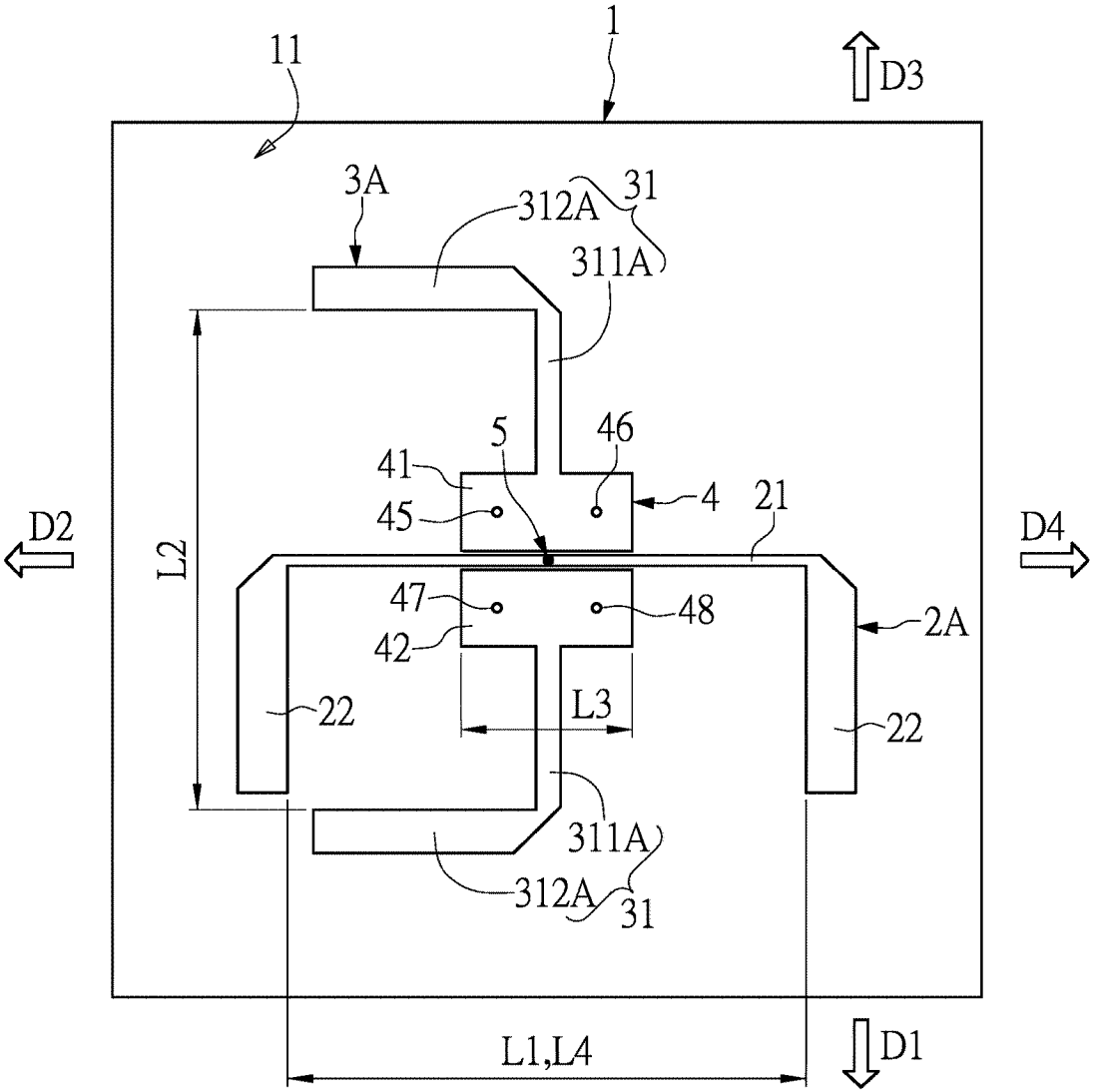
FIG. 3 is a schematic planar view of a first antenna, a second antenna, and a coupling unit on a first board surface of the dual-polarized antenna structure according to the first embodiment of the present disclosure.
Figure 4:
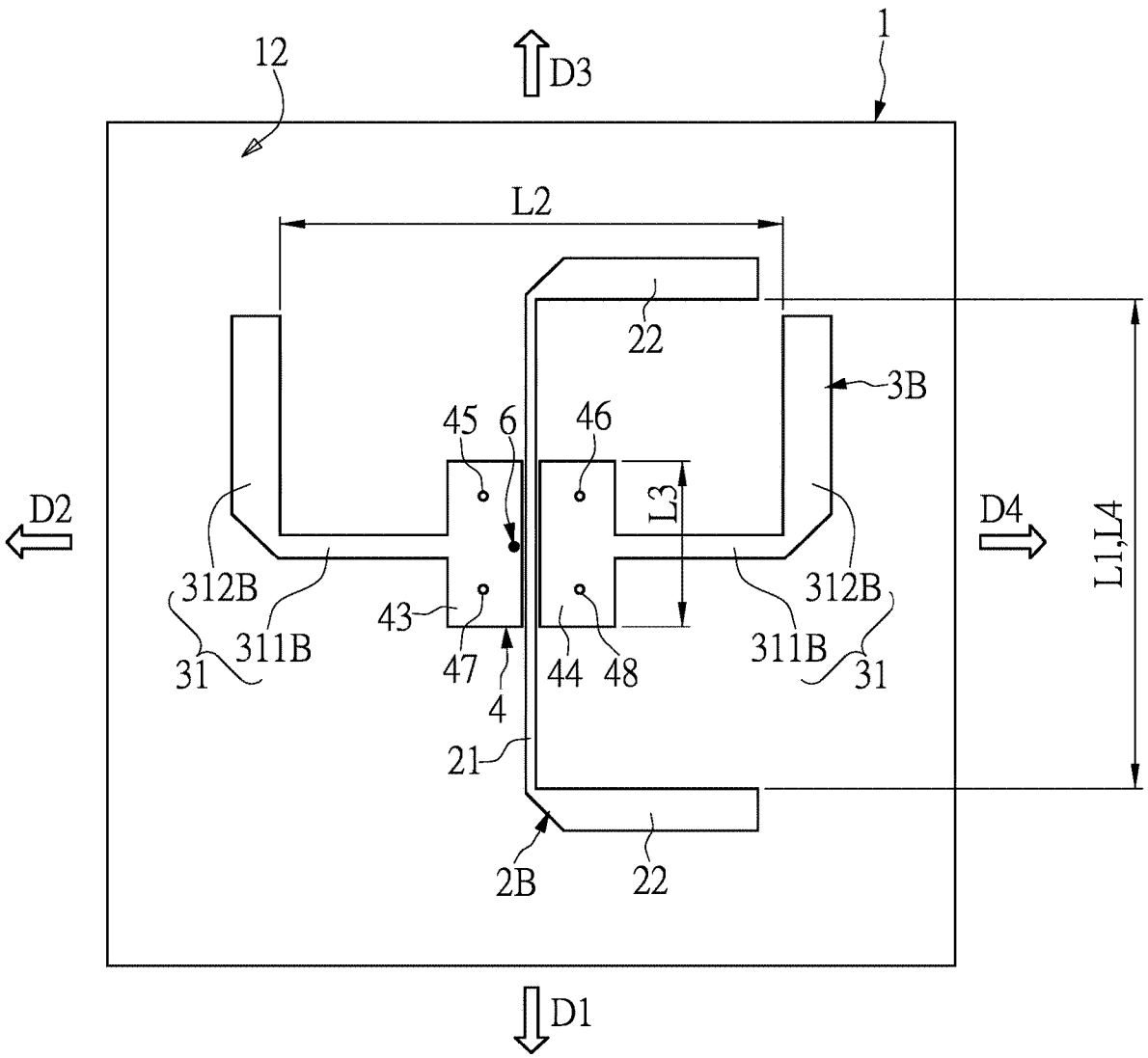
FIG. 4 is a schematic planar view of a first antenna, a second antenna, and a coupling unit on a second board surface of the dual-polarized antenna structure according to the first embodiment of the present disclosure.

Referring to FIG. 1, FIG. 3, and FIG. 4, the two first antennas 2A, 2B are respectively disposed on the first board surface 11 and the second board surface 12. Each of the two first antennas 2A, 2B in the present embodiment has a main middle segment 21 and two main side segments 22 that are respectively connected to two ends of the main middle segment 21. The two main side segments 22 of each of the two first antennas 2A, 2B are spaced apart from each other by a shortest distance L1, and the shortest distance L1 is preferably greater than or equal to 0.5 times a wavelength corresponding to a center frequency of the transmission frequency band, so that each of the two first antennas 2A, 2B can achieve an effect of having a high gain value.

Preferably, in any one of the two first antennas 2A, 2B, the two main side segments 22 are parallel to each other and are perpendicular to the main middle segment 21, so that the two first antennas 2A, 2B are substantially in a U-shape, but the present disclosure is not limited thereto. For example, in another embodiment of the present disclosure (not shown), each of the two first antennas 2A, 2B can also be in a V-shape or a W-shape.

In the present embodiment, a region defined by orthogonally projecting the main middle segment 21 on the first board surface 11 onto the second board surface 12 is perpendicular to the main middle segment 21 on the second board surface 12, and an end of each of the two main side segments 22 (i.e., two ends of a same side of the first antenna 2A) on the first board surface 11 extends in the first direction D1 (e.g., a lower side of FIG. 3), and an end of each of the two main side segments 22 (i.e., two ends of a same side of the first antenna 2B) on the second board surface 12 extends in the fourth direction D4 (e.g., the right side of FIG. 4).

In other words, referring to FIG. 1, an opening of the first antenna 2A located on the first board surface 11 faces toward the lower side of the insulating substrate 1, and an opening of the first antenna 2B located on the second board surface 12 faces toward the right side of the insulating substrate 1. That is, a three-fold rotational symmetry relationship exists between the first antenna 2A located on the first board surface 11 and the first antenna 2B located on the second board surface 12.

Referring to FIG. 1, FIG. 3, and FIG. 4, the two second antennas 3A, 3B are respectively disposed on the first board surface 11 and the second board surface 12, and each of the two second antennas 3A, 3B has two sub-antennas 31 that are spaced apart from each other.

In detail, in the second antennas 3A disposed on the first board surface 11, the two sub-antennas 31 each have a first sub-middle segment 311A and a sub-side segment 312A. The two first sub-middle segments 311A are arranged along a straight line and are separately located on two sides of the main middle segment 21, so that the two first sub-middle segments 311A do not contact the main middle segment 21 on the first board surface 11. A region defined by orthogonally projecting the two first sub-middle segments 311A onto the second board surface 12 overlaps with the main middle segment 21 on the second board surface 12. In other words, the two first sub-middle segments 311A correspond in position to the main middle segment 21 on the second board surface 12.

It should be noted that a width of each of the two first sub-middle segments 311A in the present embodiment is greater than a width of any one of the two main middle segments 21, but the present disclosure is not limited thereto. For example, in another embodiment of the present disclosure (not shown), the width of each of the two first sub-middle segments 311A may also be equal to or less than the width of any one of the main middle segments 21.

Furthermore, in the second antenna 3A disposed on the first board surface 11, the two first sub-middle segments 311A respectively have two ends that are away from each other, and the two ends are respectively connected to the two first sub-side segments 312A. An end of each of the two first sub-side segments 312A (i.e., the two ends of the two first sub-middle segments 311A) extends in the second direction D2 (i.e., a left side of FIG. 3). In other words, referring to FIG. 1, the two sub-antennas 31 located on the first board surface 11 can jointly form a U-shaped structure that is similar to any one of the first antennas 2A, 2B, and an opening jointly formed by the two sub-antennas 31 faces the left side of the insulating substrate 1.

It should be noted that in the present embodiment, the two first sub-side segments 312A located on the first board surface 11 are parallel to each other, and are respectively perpendicular to the two first sub-middle segments 311A, but the present disclosure is not limited thereto. For example, in another embodiment of the present disclosure (not shown), in the two sub-antennas 31 on the first board surface 11, the two first sub-side segments 312A may also be non-parallel to each other and non-perpendicular to the two first sub-middle segments 311A, so that the two sub-antennas 31 can jointly form a W-shaped structure.

Referring to FIG. 4, in the second antenna 3B disposed on the second board surface 12, the two sub-antennas 31 each have a second sub-middle segment 311B and a second sub-side segment 312B. The two second sub-middle segments 311B are arranged along a straight line and are separately located on two sides of the main middle segment 21, so that the two second sub-middle segments 311B do not contact the main middle segment 21 on the second board surface 12. A region defined by orthogonally projecting the two second sub-middle segments 311B onto the first board surface 11 overlaps with the main middle segment 21 on the first board surface 11. In other words, the two second sub-middle segments 311B correspond in position to the main middle segment 21 on the first board surface 11.

Furthermore, in the second antenna 3B disposed on the second board surface 12, the two second sub-middle segments 311B respectively have two ends that are away from each other, and the two ends are respectively connected to the two second sub-side segments 312B. An end of each of the two second sub-side segments 312B (i.e., the two ends of the two second sub-middle segments 311B) extends in the third direction D3 (i.e., an upper side of FIG. 4). In other words, referring to FIG. 1, the two sub-antennas 31 located on the second board surface 12 can jointly form a U-shaped structure that is similar to any one of the first antennas 2A, 2B, and an opening jointly formed by the two sub-antennas 31 faces the upper side of the insulating substrate 1.

It should be noted that the end of each of the two second sub-side segments 312B extends in the third direction D3 (i.e., the upper side of FIG. 4), and the end of each of the two first sub-side segments 312A extends in the second direction D2 (i.e., the left side of FIG. 3). That is, a three-fold rotational symmetry relationship exists between the second antenna 3A and the second antenna 3B.

It should be noted that in the present embodiment, the two second sub-side segments 312B located on the second board surface 12 are parallel to each other, and are respectively perpendicular to the two second sub-middle segments 311B, but the present disclosure is not limited thereto. For example, in another embodiment of the present disclosure (not shown), in the two sub-antennas 31 on the second board surface 12, the two second sub-side segments 312B may also be non-parallel to each other and non-perpendicular to the two second sub-middle segments 311B, so that the two sub-antennas 31 can jointly form a W-shaped structure.

It is worth noting that, preferably, a shortest distance L2 is defined between the two first sub-side segments 312A and between the two second sub-side segments 312B, and the shortest distance L2 is greater than or equal to 0.5 times a wavelength corresponding to the center frequency of the transmission frequency band, so that each of the two second antennas 3A, 3B can achieve the effect of having a high gain value.

In addition, in the present embodiment, the shortest distance L2 is preferably equal to the shortest distance L1 between the two main side segments 22 on the first board surface 11 and the shortest distance L1 between the two main side segments 22 on the second board surface 12. Further, a region defined by orthogonally projecting a middle position between the two first sub-middle segments 311A (or a middle position of the shortest distance L2 between the two first sub-middle segments 311A) onto the second board surface 12 overlaps with a middle position between the two second sub-middle segments 311B (or a middle position of the shortest distance L2 of the two second sub-middle segments 311B).

Referring to FIG. 2 to FIG. 4, the coupling unit 4 is disposed on the insulating substrate 1, and is electrically coupled to the two sub-antennas 31 on the first board surface 11 and the two sub-antennas 31 on the second board surface 12. The following description describes the structure and connection relation of each component of the coupling unit 4.

The coupling unit 4 includes a first coupling element 41 and a second coupling element 42 disposed on the first board surface 11, a third coupling element 43 and a fourth coupling element 44 disposed on the second board surface 12, and a first conductive element 45, a second conductive element 46, a third conductive element 47, and a fourth conductive element 48 that penetrate through the insulating substrate 1.

Each of the first coupling element 41, the second coupling element 42, the third coupling element 43, and the fourth coupling element 44 in the present embodiment is a coplanar waveguide in a rectangular shape, but the present disclosure is not limited thereto. For example, each of the first coupling element 41, the second coupling element 42, the third coupling element 43, and the fourth coupling element 44 can be a microstrip in a semicircular shape or other shapes, or can be other conductive elements.

Referring to FIG. 3, in the first board surface 11, the first coupling element 41 and the second coupling element 42 are respectively and symmetrically arranged on two sides of the main middle segment 21 with the main middle segment 21 as the central axis, and the first coupling element 41 and the second coupling element 42 do not contact the main middle segment 21. Moreover, the first coupling element 41 and the second coupling element 42 are respectively and electrically coupled to the two first sub-middle segments 311A.

Referring to FIG. 4, in the second board surface 12, the third coupling element 43 and the fourth coupling element 44 are respectively and symmetrically arranged on two sides of the main middle segment 21 with the main middle segment 21 as the central axis, and the third coupling element 43 and the fourth coupling element 44 do not contact the main middle segment 21. Moreover, the third coupling element 43 and the fourth coupling element 44 are respectively and electrically coupled to the two second sub-middle segments 311B.

Ideally, an area of the first coupling element 41, an area of the second coupling element 42, an area of the third coupling element 43, and an area of the fourth coupling element 44 are preferably equal, and a region defined by orthogonally projecting the first coupling element 41 and the second coupling element 42 onto the second board surface 12 is substantially overlapped with at least of 90% of a total area of the third coupling element 43 and the area of the fourth coupling element 44, but the present disclosure is not limited thereto. In practice, the areas of the first coupling element 41, the second coupling element 42, the third coupling element 43, and the fourth coupling element 44 can be adjusted according to practical requirements.

In addition, each of the first conductive element 45, the second conductive element 46, the third conductive element 47, and the fourth conductive element 48 in the present disclosure is a via hole, but the present disclosure is not limited thereto. The first conductive element 45 is arranged between the first coupling element 41 and the third coupling element 43, and is electrically coupled to the first coupling element 41 and the third coupling element 43. The second conductive element 46 is arranged between the first coupling element 41 and the fourth coupling element 44, and is electrically coupled to the first coupling element 41 and the fourth coupling element 44. The third conductive element 47 is arranged between the second coupling element 42 and the third coupling element 43, and is electrically coupled to the second coupling element 42 and the third coupling element 43. The fourth conductive element 48 is arranged between the second coupling element 42 and the fourth coupling element 44, and is electrically coupled to the second coupling element 42 and the fourth coupling element 44.

It should be noted that each of the first coupling element 41, the second coupling element 42, the third coupling element 43, and the fourth coupling element 44 has a longest length L3 along a longitudinal direction of the main middle segment 21 adjacent thereto, and the longest length L3 is less than or equal to 50% of a length L4 of the main middle segment 21, so as to prevent a gain value of the dual-polarized antenna structure 100A from being affected.

Referring to FIG. 2, the first feeding point 5 is disposed on the insulating substrate 1 and substantially corresponds in position to a middle position between the two first antennas 2A, 2B, and the first feeding point 5 is electrically coupled to the two first antennas 2A, 2B. In the present disclosure, the first feeding point 5 is electrically coupled to the two first antennas 2A, 2B by penetrating through the insulating substrate 1, but the present disclosure is not limited thereto. For example, in another embodiment of the present disclosure (not shown), the first feeding point 5 can also be electrically coupled to the two first antennas 2A, 2B by a wire.

The second feeding point 6 is electrically coupled to the coupling unit 4 and substantially corresponds in position to a middle position between the two second antennas 3A, 3B. Specifically, the second feeding point 6 in the present embodiment is connected to the third coupling element 43 from one side of the second board surface 12, and a location of the second feeding point 6 in the present embodiment is close to a location of the first feeding point 5, so that the dual-polarized antenna structure 100A can have a same phase angle.

Naturally, in practice, the location of the first feeding point 5 can be reasonably deviated from the middle position between the two first antennas 2A, 2B, and the location of the second feeding point 6 can be reasonably deviated from the middle position between the two second antennas 3A, 3B. Theoretically however, the first feeding point 5 is best positioned at the middle position between the two first antennas 2A, 2B, and the second feeding point 6 is best positioned at the middle position of the two second antennas 3A, 3B.

Figure 5:
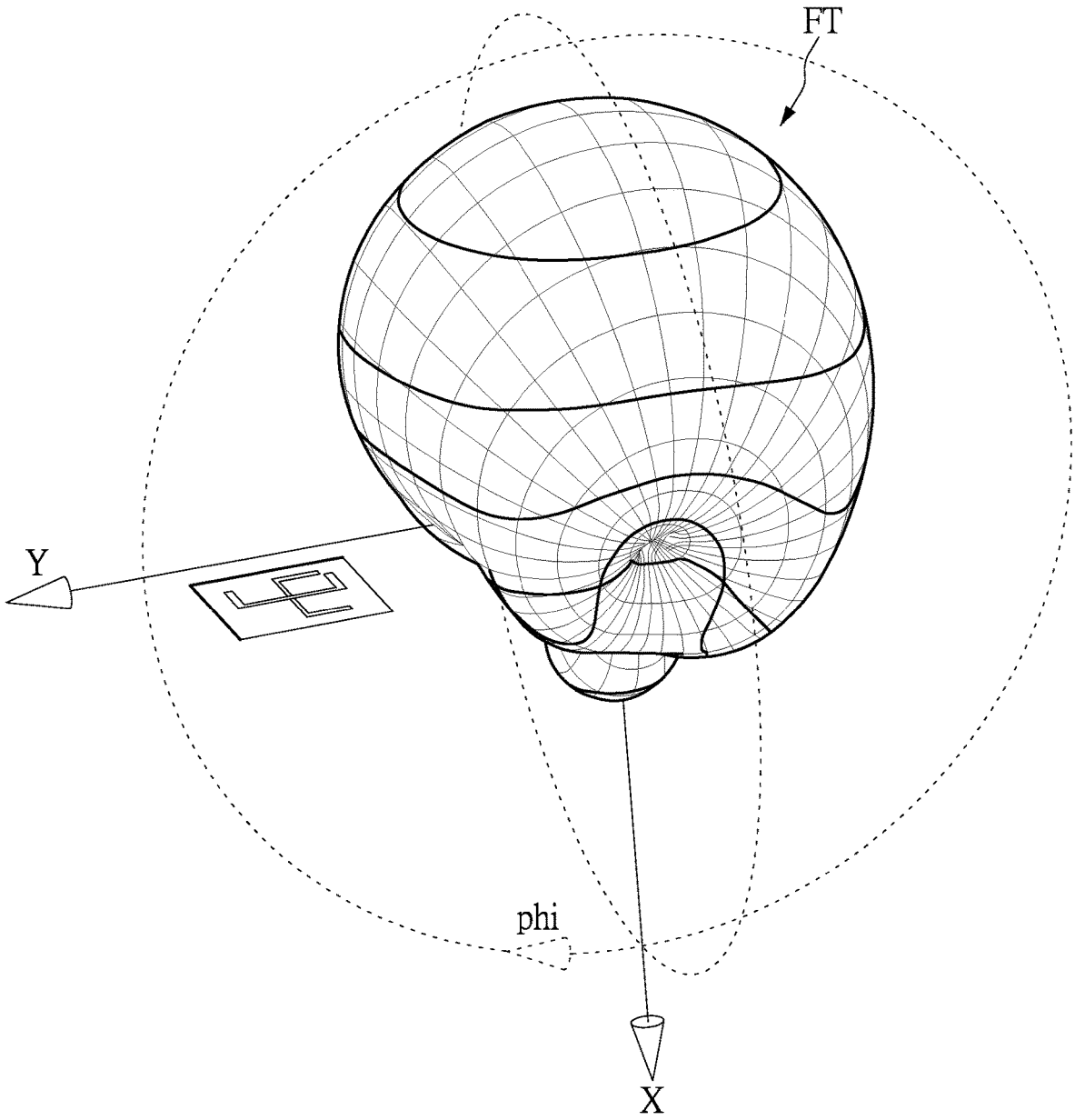
FIG. 5 is a schematic diagram of a radiation pattern of the dual-polarized antenna structure according to the first embodiment of the present disclosure.
Figure 6:
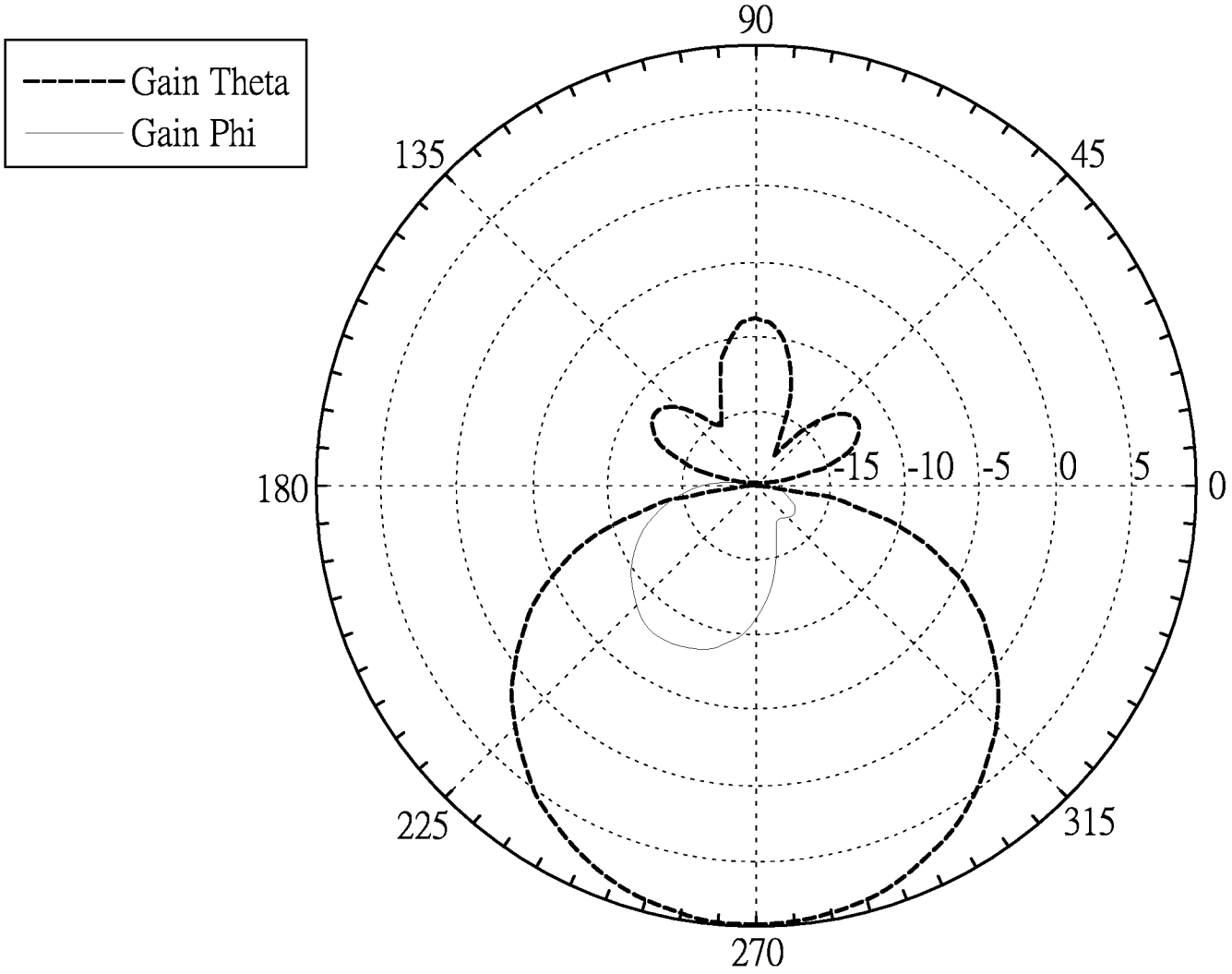
FIG. 6 is a schematic diagram of the radiation pattern of the dual-polarized antenna structure in an H-plane according to the first embodiment of the present disclosure.
Figure 7:
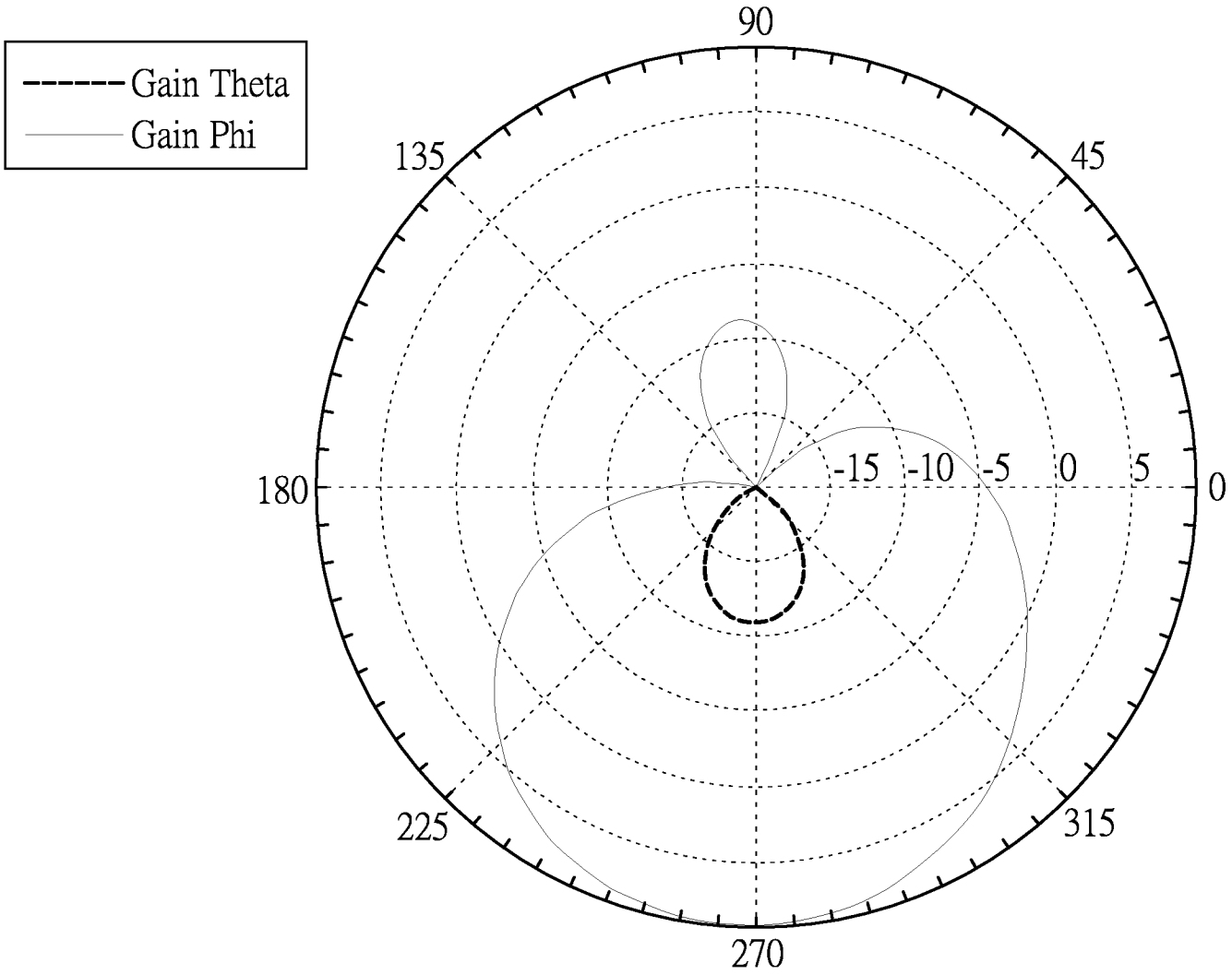
FIG. 7 is a schematic diagram of the radiation pattern of the dual-polarized antenna structure in an E-plane according to the first embodiment of the present disclosure.

The dual-polarized antenna structure 100A provided in the present embodiment can effectively and significantly increase the gain value through the above-mentioned structure. In order to more specifically show the effect of the "high gain value" in the dual-polarized antenna structure 100A, FIG. 5 to FIG. 7 show an actual radiation pattern and data measured by the dual-polarized antenna structure 100A. A radiation pattern FT in FIG. 5 is generated by the dual-polarized antenna structure 100A. FIG. 6 is a schematic diagram of the radiation pattern FT in an H-plane, and FIG. 7 is a schematic diagram of the radiation pattern FT in an E-plane. It is obvious from FIG. 5 to FIG. 7 that, through the above structure, a maximum gain value in the E plane can be greater than 9 dBi, and the maximum gain value in the H plane can also be greater than 9 dBi.

Second Embodiment

Figure 8:
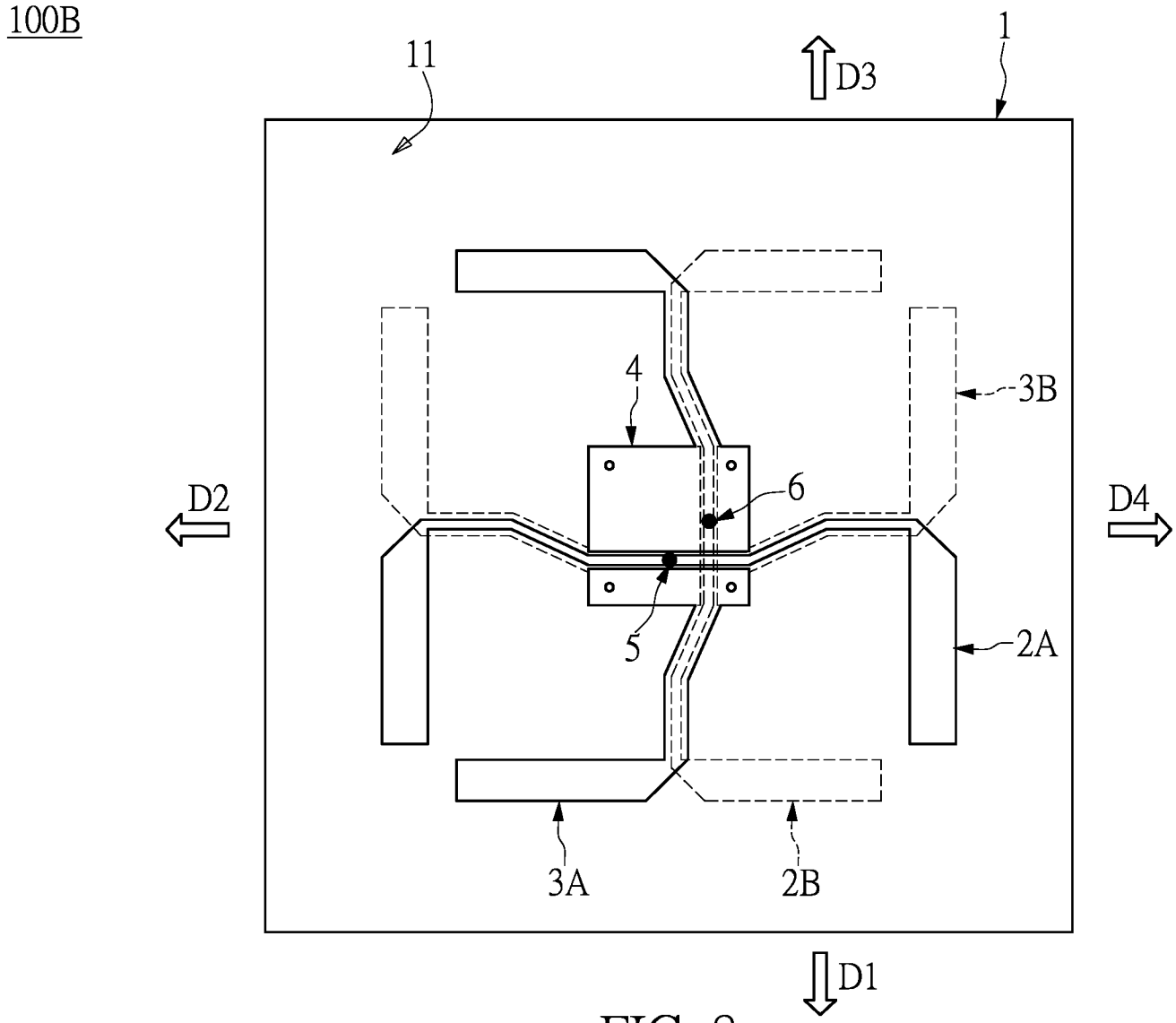
FIG. 8 is a schematic planar view of the dual-polarized antenna structure according to a second embodiment of the present disclosure.
Figure 9:
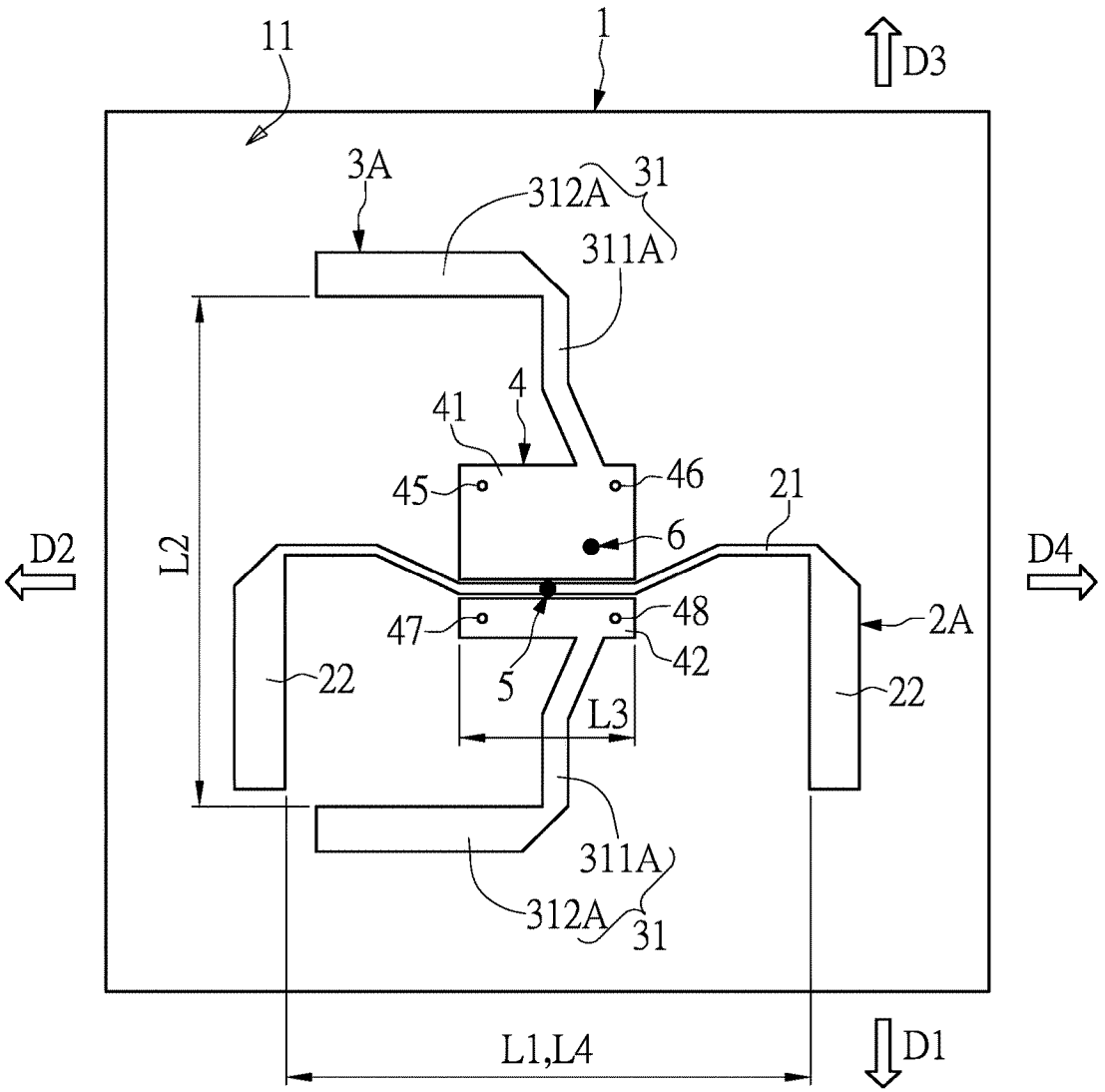
FIG. 9 is a schematic planar view of a first antenna, a second antenna, and a coupling unit on a first board surface of the dual-polarized antenna structure according to the second embodiment of the present disclosure.
Figure 10:
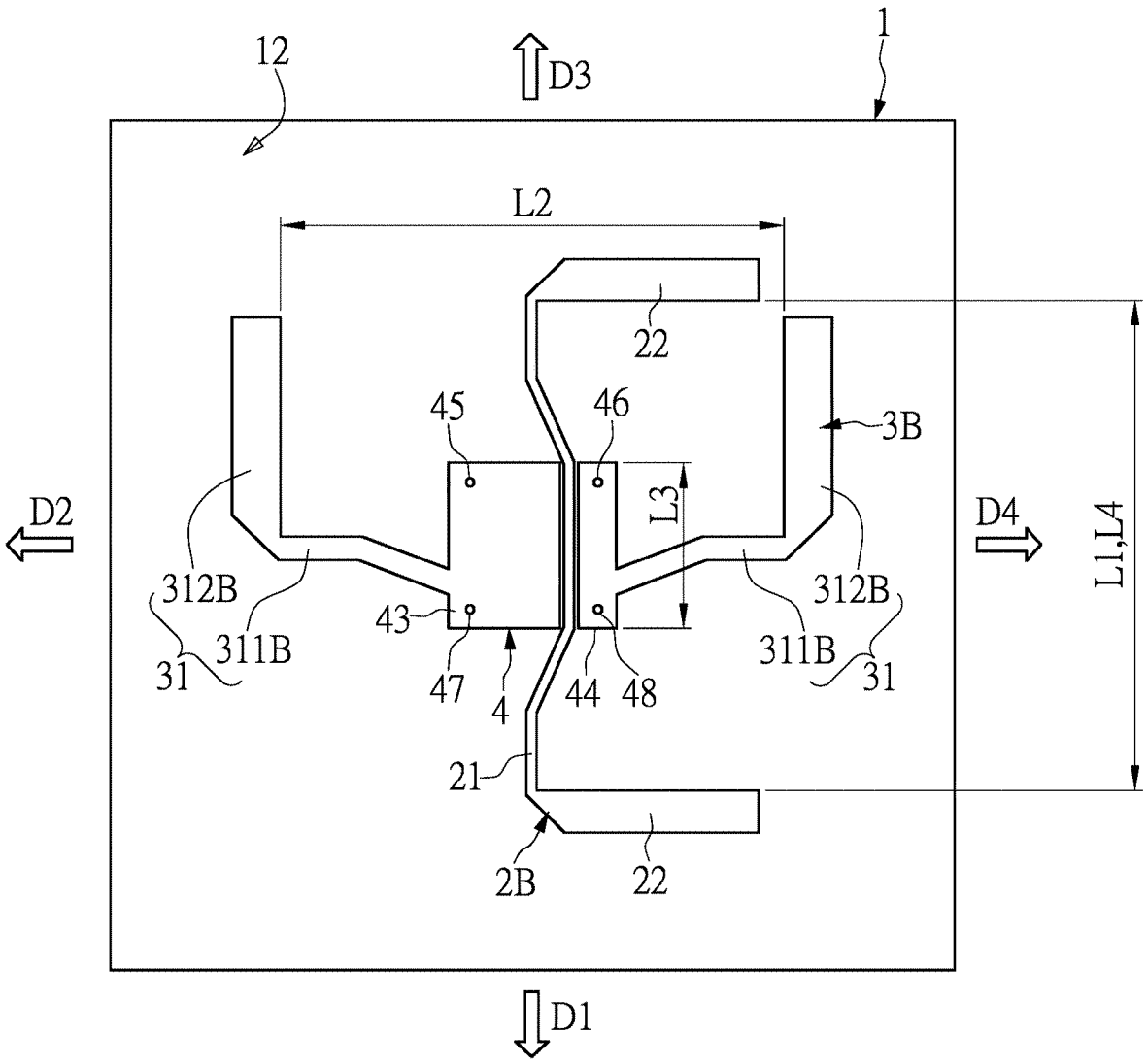
FIG. 10 is a schematic planar view of a first antenna, a second antenna, and a coupling unit on a second board surface of the dual-polarized antenna structure according to the second embodiment of the present disclosure.

Referring to FIG. 8 to FIG. 10, a second embodiment of the present disclosure provides a dual-polarized antenna structure 100B that is similar to the dual-polarized antenna structure 100A of the first embodiment, and the similarities therebetween will not be repeated herein. The difference between the dual-polarized antenna structure 100B of the present embodiment and the first embodiment mainly resides in that the areas of the first coupling element 41 the second coupling element 42, the third coupling element 43, and the fourth coupling element 44 in the present embodiment are not all the same.

Specifically, in the present embodiment, the area of the first coupling element 41 and the area of the third coupling element 43 are equal, and the area of the second coupling element 42 and the area of the fourth coupling element 44 are equal. However, each of the area of the first coupling element 41 and the area of the third coupling element 43 is greater than each of the area of the second coupling element 42 and the area of the fourth coupling element 44. For example, the area of the first coupling element 41 is greater than the area of the second coupling element 42, and the area of the third coupling element 43 is greater than the area of the fourth coupling element 44.

Therefore, under the condition that a length of each of the two first sub-middle segments 311A (or the two second sub-middle segments 311B) is unchanged, the middle position between the two first sub-middle segments 311A (or the two second sub-middle segments 311B) can be adjusted by using an area difference between the first coupling element 41 and the second coupling element 42 (or the third coupling element 43 and the fourth coupling element 44).

In other words, a region defined by orthogonally projecting the middle position between the two sub-antennas 31 on the first board surface 11 onto the second board surface 12 does not overlap with the middle position between the two sub-antennas 31 on the second board surface 12. Accordingly, the first feeding point 5 and the second feeding point 6 can be disposed on a same side of the insulating substrate 1 (e.g., the first feeding point 5 and the second feeding point 6 are disposed on the first board surface 11).

The first feeding point 5 penetrates through the insulating substrate 1, and is electrically coupled to the main middle segment 21 on the first board surface 11 and the third coupling element 43. The second feeding point 6 penetrates through the insulating substrate 1, and is electrically coupled to the main middle segment 21 on the second board surface 12 and the first coupling element 41.

Third Embodiment

Referring to FIG. 11 to FIG. 14, a third embodiment of the present disclosure provides a dual-polarized antenna structure 100C that is similar to the dual-polarized antenna structure 100A of the first embodiment, and the similarities therebetween will not be repeated herein. The difference between the dual-polarized antenna structure 100C of the present embodiment and the first embodiment are mainly as follows.

In the second board surface 12, each of the two sub-antennas 31 further includes a skewed segment 313. Specifically, the skewed segment 313 is connected to one end of the second sub-middle segment 311B, and an angle between the skewed segment 313 and the second sub-middle segment 311B is less than or equal to 180 degrees.

In addition, the coupling unit 4 in the present embodiment only includes a coupling element 41' and a conductive element 49. The coupling element 41' in the present embodiment is a coplanar waveguide (CPW) in a rectangular shape, but the present disclosure is not limited thereto. The coupling element 41' is disposed on the first board surface 11, and is located between the main middle segment 21 on the first board surface 11 and the two first sub-middle segments 311A. The coupling element 41' is integrally connected to the main middle segment 21 on the first board surface 11 and the two first sub-middle segments 311A, so that the coupling element 41' is electrically coupled to the main middle segment 21 on the first board surface 11 and the two first sub-middle segments 311A.

The coupling element 41' has a notch SP, and the notch SP does not cover the insulating substrate 1, so that the first board surface 11 is exposed from a surface of the coupling unit 4 through the notch SP. Further, a region defined by orthogonally projecting an inner edge of the coupling element 41' in the notch SP onto the second board surface 11 covers two of the skewed segments 313.

Figure 11:
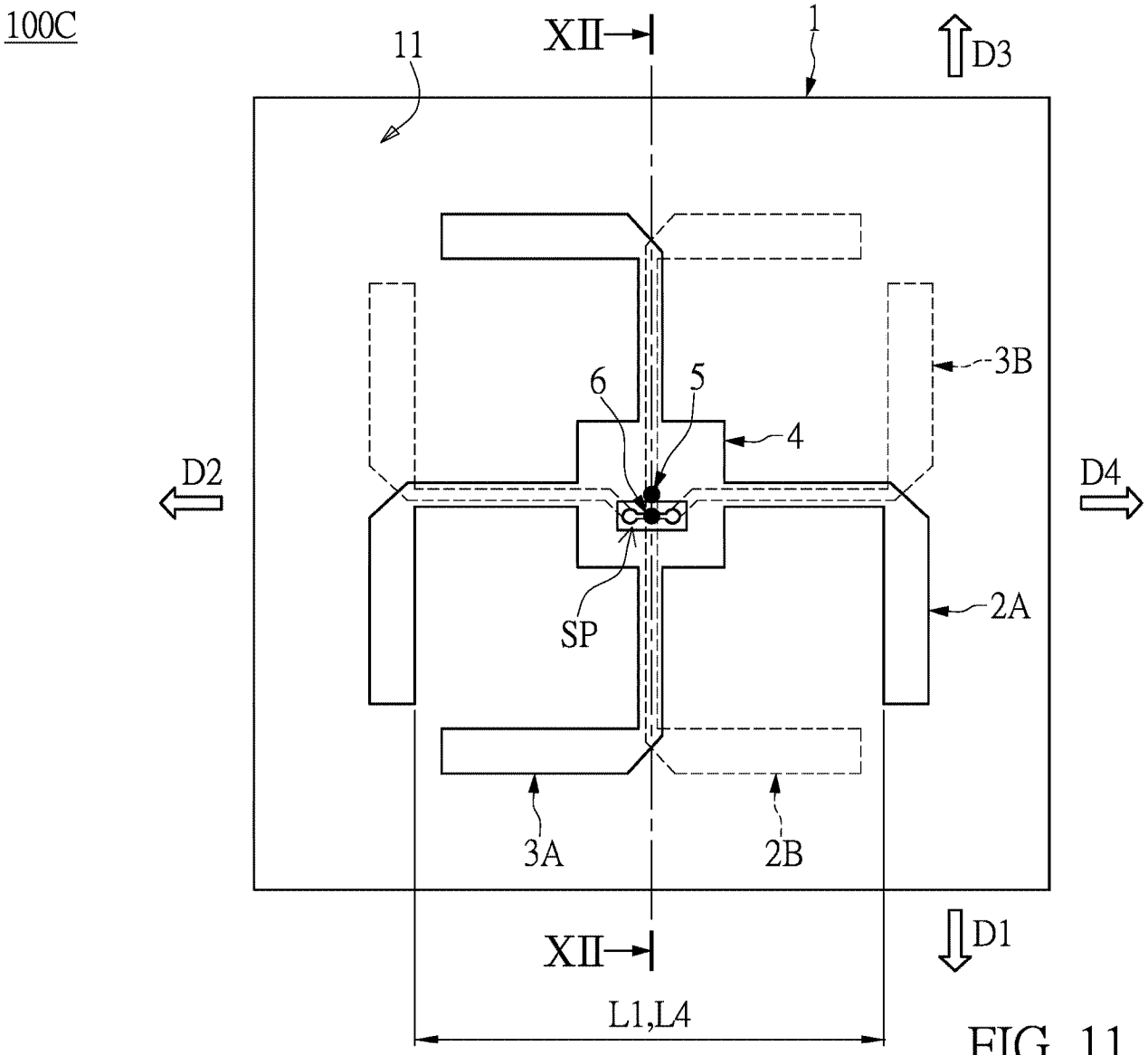
FIG. 11 is a schematic planar view of the dual-polarized antenna structure according to a third embodiment of the present disclosure.
Figure 12:
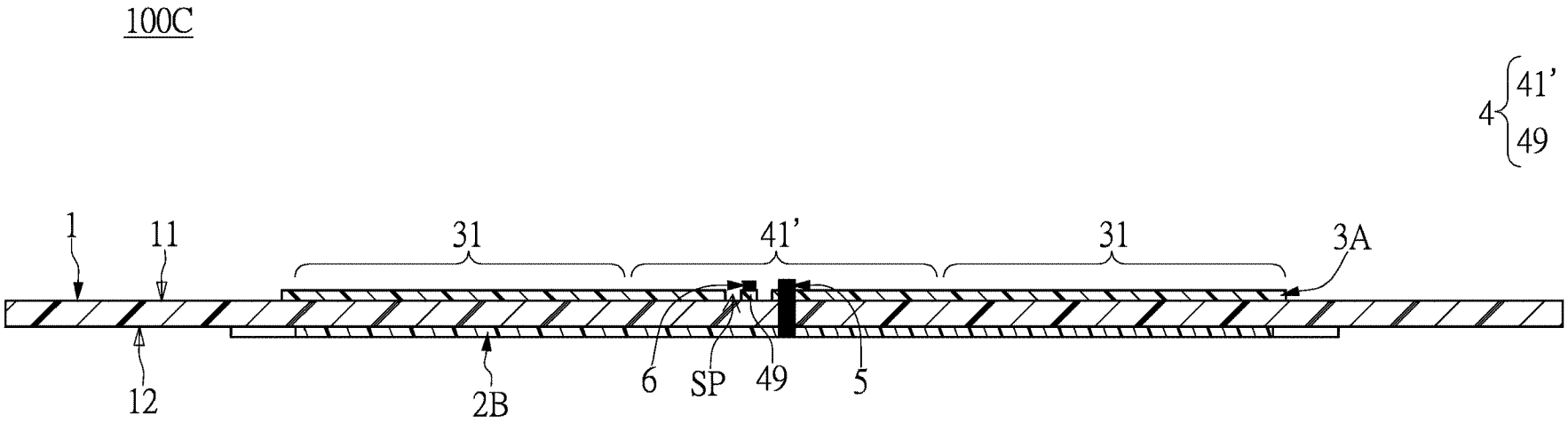
FIG. 12 is a cross-sectional view taken along line XII-XII of FIG. 11.
Figure 13:
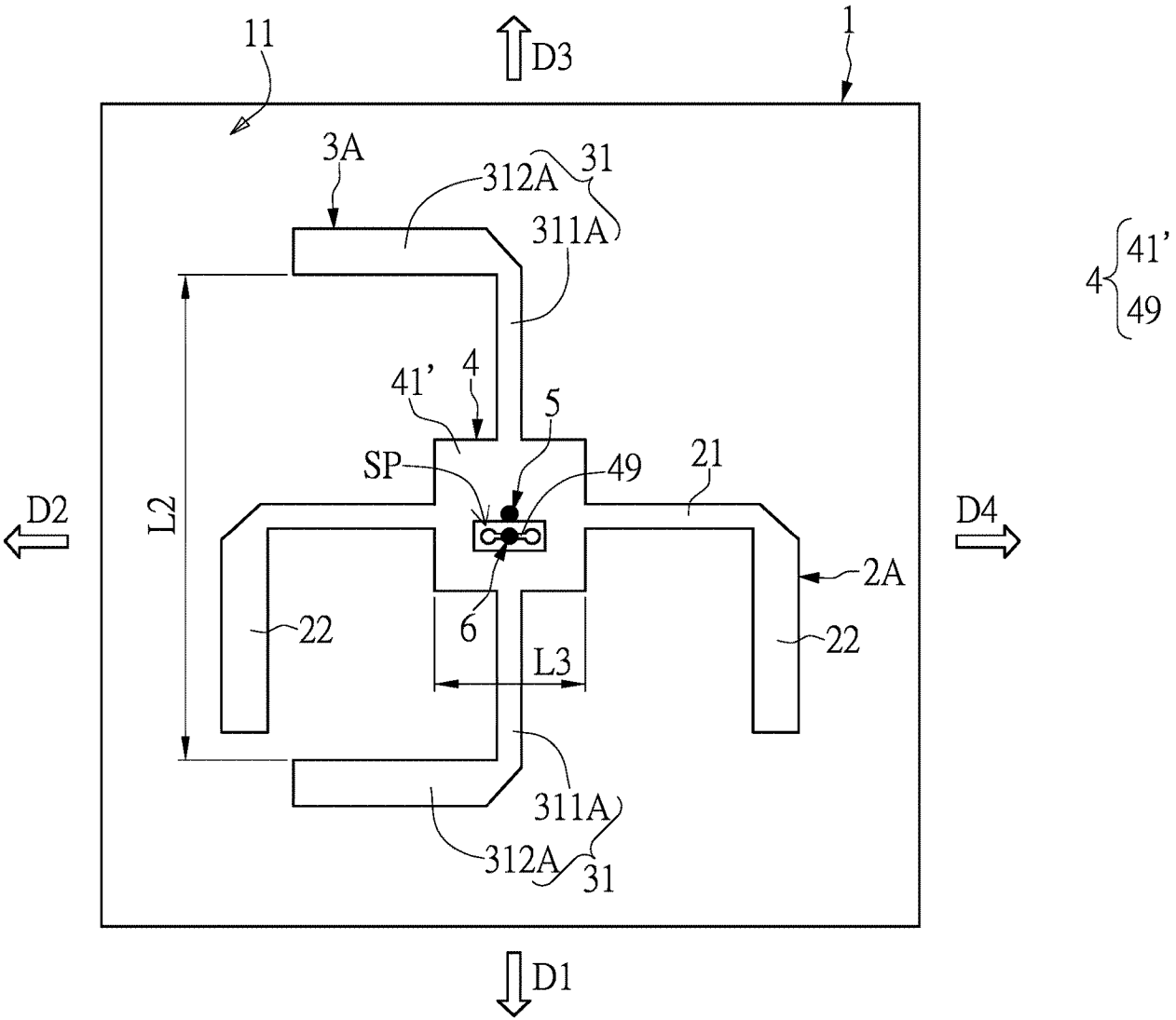
FIG. 13 is a schematic planar view of a first antenna, a second antenna, and a coupling unit on a first board surface of the dual-polarized antenna structure according to the third embodiment of the present disclosure.
Figure 14:
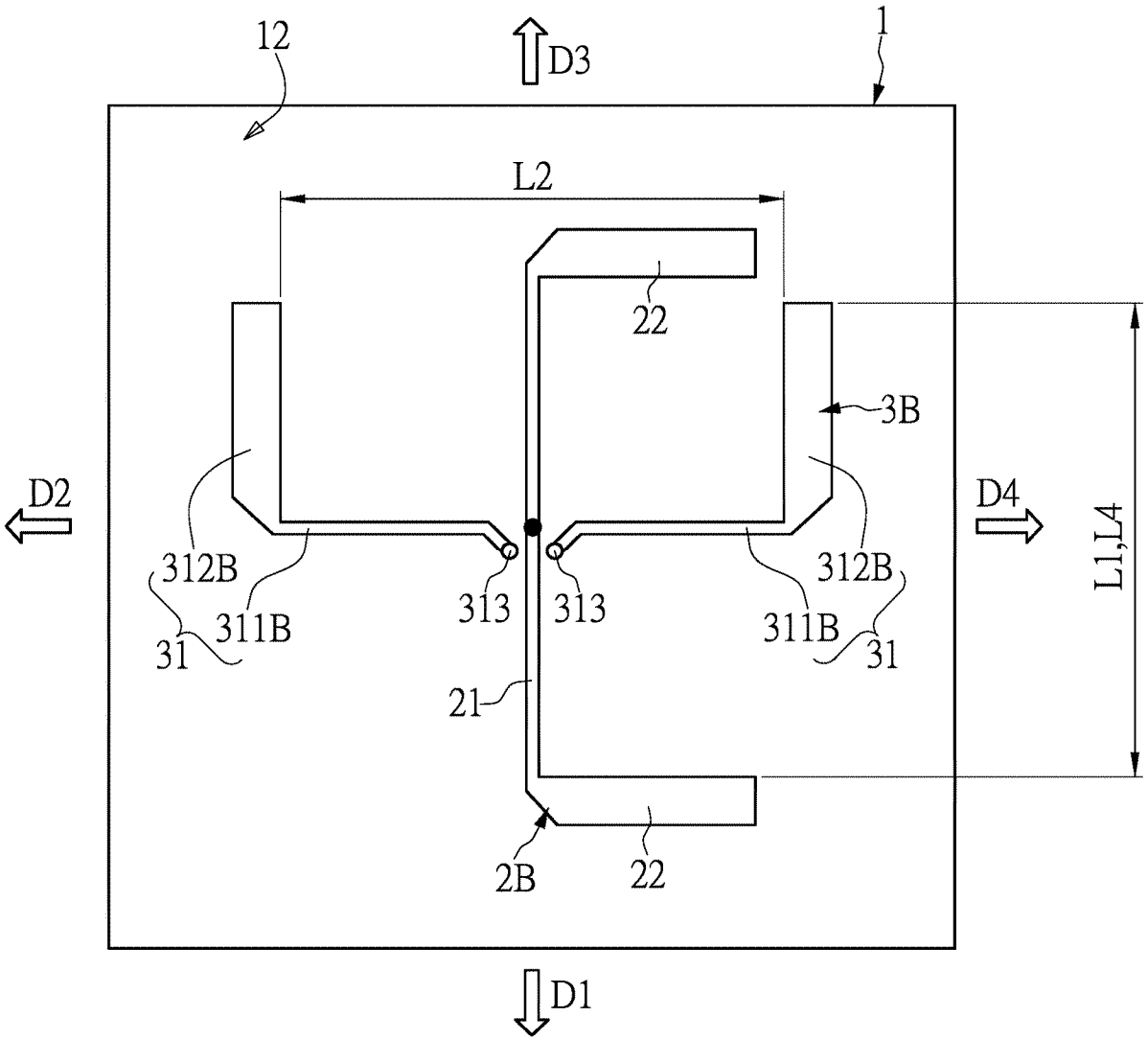
FIG. 14 is a schematic planar view of a first antenna, a second antenna, and a coupling unit on a second board surface of the dual-polarized antenna structure according to the third embodiment of the present disclosure.

The conductive element 49 in the present embodiment is a long wire, but the present embodiment is not limited thereto. The conductive element 49 is disposed on the first board surface 11 and located in the notch SP (as shown in FIG. 11 and FIG. 13). Two ends of the conductive element 49 penetrate through the insulating substrate 1, and are respectively and electrically coupled to the two skewed segments 313 on the second board surface 12 (as shown in FIG. 11 and FIG. 12). In addition, the first feeding point 5 is electrically coupled to the coupling element 41', and the second feeding point 6 is electrically coupled to the conductive element 49 by a position of the notch SP.

Beneficial Effects of the Embodiments

In conclusion, by virtue of "the coupling unit being disposed on the insulating substrate and being electrically coupled to the two sub-antennas on the first board surface and the two sub-antennas on the second board surface" and "the first feeding point corresponding in position to the middle position between the two first antennas and being electrically coupled to the two first antennas, and the second feeding point corresponding in position to the middle position between the two second antennas and being electrically coupled to the coupling unit," the dual-polarized antenna structure provided by the present disclosure can have advantages of high gain value and low cost.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A dual-polarized antenna structure, comprising:

an insulating substrate sequentially defining a first direction, a second direction, a third direction, and a fourth direction that sequentially differ by an angle of 90 degrees, wherein the insulating substrate has a first board surface and a second board surface that is opposite to the first board surface;

two first antennas disposed on the first board surface and the second board surface, respectively, wherein each of the two first antennas has a main middle segment and two main side segments that are respectively connected to two ends of the main middle segment, wherein a region defined by orthogonally projecting the main middle segment on the first board surface onto the second board surface is perpendicular to the main middle segment on the second board surface, and wherein the two main side segments on the first board surface extend in the first direction, and the two main side segments on the second board surface extend in the fourth direction;

two second antennas disposed on the first board surface and the second board surface, respectively, wherein each of the two second antennas includes two sub-antennas;

wherein, in one of the two second antennas disposed on the first board surface, the two sub-antennas each have one of two first sub-middle segments and one of two first sub-side segments, wherein the two first sub-middle segments are disposed on the first board surface and are spaced apart from each other, and a region defined by orthogonally projecting the two first sub-middle segments onto the second board surface overlaps with the main middle segment on the second board surface, and wherein, in one of the two second antennas disposed on the first board surface, the two first sub-middle segments each have one of two ends that are away from each other, the two ends are respectively connected to the two first sub-side segments, and the two first sub-side segments extend in the second direction;

wherein, in one of the two second antennas disposed on the second board surface, the two sub-antennas each have one of two second sub-middle segments and one of two second sub-side segments, wherein the two second sub-middle segments are disposed on the second board surface and are spaced apart from each other, and a region defined by orthogonally projecting the two second sub-middle segments onto the first board surface overlaps with the main middle segment on the first board surface, and wherein, in one of the two second antennas disposed on the second board surface, the two second sub-middle segments each have one of two ends that are away from each other, the two ends are respectively connected to the two second sub-side segments, and the two second sub-side segments extend in the third direction;

a coupling unit disposed on the insulating substrate and electrically coupled to the two sub-antennas on the first board surface and the two sub-antennas on the second board surface;

a first feeding point disposed on the insulating substrate and corresponding in position to a middle position between the two first antennas, wherein the first feeding point is electrically coupled to the two first antennas; and a second feeding point electrically coupled to the coupling unit and corresponding in position to a middle position between the two second antennas.

2. The dual-polarized antenna structure according to claim 1, wherein the coupling unit includes:

a first coupling element and a second coupling element that are disposed on the first board surface, wherein the first coupling element and the second coupling element are arranged on two sides of the main middle segment on the first board surface, respectively;

a third coupling element and a fourth coupling element that are disposed on the second board surface, wherein the third coupling element and the fourth coupling element are arranged on two sides of the main middle segment on the second board surface, respectively;

a first conductive element penetrating through the insulating substrate and electrically coupled to the first coupling element and the third coupling element;

a second conductive element penetrating through the insulating substrate and electrically coupled to the first coupling element and the fourth coupling element;

a third conductive element penetrating through the insulating substrate and electrically coupled to the second coupling element and the third coupling element; and a fourth conductive element penetrating through the insulating substrate and electrically coupled to the second coupling element and the fourth coupling element.

3. The dual-polarized antenna structure according to claim 2, wherein each of the first coupling element, the second coupling element, the third coupling element, and the fourth coupling element is a coplanar waveguide; wherein each of the first conductive element, the second conductive element, the third conductive element, and the fourth conductive element is a via hole.

4. The dual-polarized antenna structure according to claim 2, wherein a region defined by orthogonally projecting the first coupling element and the second coupling element onto the second board surface overlaps with at least of 90% of a total area of the third coupling element and the fourth coupling element.

5. The dual-polarized antenna structure according to claim 2, wherein an area of each of the first coupling element, the second coupling element, the third coupling element, and the fourth coupling element is equal to each other.

6. The dual-polarized antenna structure according to claim 2, wherein an area of the first coupling element and an area of the third coupling element are equal to each other, and an area of the second coupling element and an area of the fourth coupling element are equal to each other; wherein each of the area of the first coupling element and the area of the third coupling element is greater than each of the area of the second coupling element and the area of the fourth coupling element.

7. The dual-polarized antenna structure according to claim 6, wherein a region defined by orthogonally projecting a middle position between the two first sub-middle segments onto the second board surface does not overlap a middle position between the two second sub-middle segments.

8. The dual-polarized antenna structure according to claim 1, wherein the dual-polarized antenna structure is configured to be operated in a transmission frequency band; wherein a shortest distance between the two main side segments on the first board surface and a shortest distance between the two first sub-side segments on the first board surface are greater than or equal to 0.5 times a wavelength corresponding to a center frequency of the transmission frequency band; wherein a shortest distance between the two main side segments on the second board surface and a shortest distance between the two second sub-side segments on the second board surface are greater than or equal to 0.5 times the wavelength corresponding to the center frequency of the transmission frequency band.

9. The dual-polarized antenna structure according to claim 1, wherein a width of each of the two first sub-middle segments is greater than a width of the main middle segment of each of the two first antennas; wherein a width of each of the two second sub-middle segments is greater than a width of the main middle segment of each of the two first antennas.

10. The dual-polarized antenna structure according to claim 1, wherein a region defined by orthogonally projecting a middle position between the two first sub-middle segments onto the second board surface overlaps a middle position between the two second sub-middle segments.

* * * * *